US008012236B2

(12) United States Patent
Tokuda et al.

(10) Patent No.: US 8,012,236 B2
(45) Date of Patent: Sep. 6, 2011

(54) METHOD AND APPARATUS FOR PRODUCING REDUCED METAL

(75) Inventors: Koji Tokuda, Hyogo (JP); Shoichi Kikuchi, Hyogo (JP); Osamu Tsuge, Hyogo (JP)

(73) Assignee: Kabushiki Kaisha Kobe Seiko Sho Kobe Steel, Ltd., Kobe-shi (JP)

( * ) Notice: Subject to any disclaimer, the term of this patent is extended or adjusted under 35 U.S.C. 154(b) by 260 days.

(21) Appl. No.: 10/553,199

(22) PCT Filed: Mar. 11, 2004

(86) PCT No.: PCT/JP2004/003216

§ 371 (c)(1),
(2), (4) Date: Oct. 13, 2005

(87) PCT Pub. No.: WO2004/092421

PCT Pub. Date: Oct. 28, 2004

(65) Prior Publication Data

US 2007/0034055 A1 Feb. 15, 2007

(30) Foreign Application Priority Data

Apr. 17, 2003 (JP) ..... 2003-112835

(51) Int. Cl.
*C21B 7/16* (2006.01)

(52) U.S. Cl. ..... 75/484; 75/475

(58) Field of Classification Search ..... 75/475, 75/484; 266/173

See application file for complete search history.

(56) References Cited

U.S. PATENT DOCUMENTS 6,413,471 B1 7/2002 Kamikawa et al.
6,478,839 B1 * 11/2002 Kansa et al. ..... 75/10.14

FOREIGN PATENT DOCUMENTS

EP 1 137 817 10/2001
EP 1 266 971 A2 12/2002

(Continued)

OTHER PUBLICATIONS

Rolf Degel, et al., "A new generation of rotary hearth furnace technology for coal based DRI production", vol. 120, No. 2, XP-000933033, Feb. 15, 2000, pp. 33-40.
U.S. Appl. No. 12/183,947, filed Jul. 31, 2008, Tsuge, et al.

*Primary Examiner* — Roy King
*Assistant Examiner* — Jie Yang
(74) *Attorney, Agent, or Firm* — Oblon, Spivak, McClelland, Maier & Neustadt, L.L.P.

(57) ABSTRACT

It is an object of the present invention to provide a technique for solving the following problem by properly controlling the flow of gas such as air (oxidizing gas): a problem that the degree of reduction cannot be increased due to the air entering a feedstock-feeding zone or a discharging zone. The technique is a method for producing reduced iron. The method includes a feedstock-feeding step of feeding a feedstock containing a carbonaceous reductant and an iron oxide-containing material into a rotary hearth furnace, a heating/reducing step of heating the feedstock to reduce iron oxide contained in the feedstock into reduced iron, a melting step of melting the reduced iron, a cooling step of cooling the molten reduced iron, and a discharging step of discharging the cooled reduced iron, these steps being performed in that order in the direction that a hearth is moved. The furnace includes flow rate-controlling partitions, arranged therein, for controlling the flow of furnace gas and the furnace gas in the cooling step is allowed to flow in the direction of the movement of the hearth with the partitions.

10 Claims, 6 Drawing Sheets

FOREIGN PATENT DOCUMENTS

| | | |
|---|---|---|
| GB | 742169 | 12/1955 |
| JP | 2000-239739 | 9/2000 |
| JP | 2003-73717 | 3/2003 |
| WO | WO 00/29628 | 5/2000 |

* cited by examiner

FIG. 5 (1)
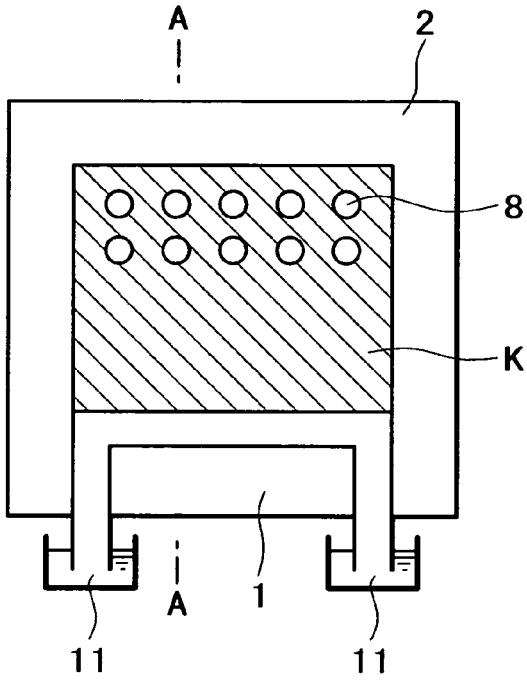
FIG. 5 (2)
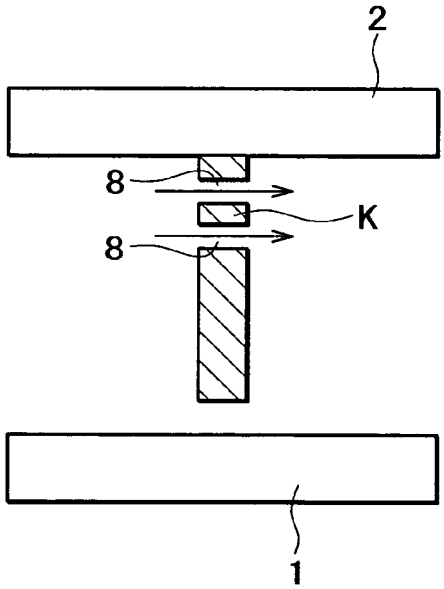

FIG. 8 (1)
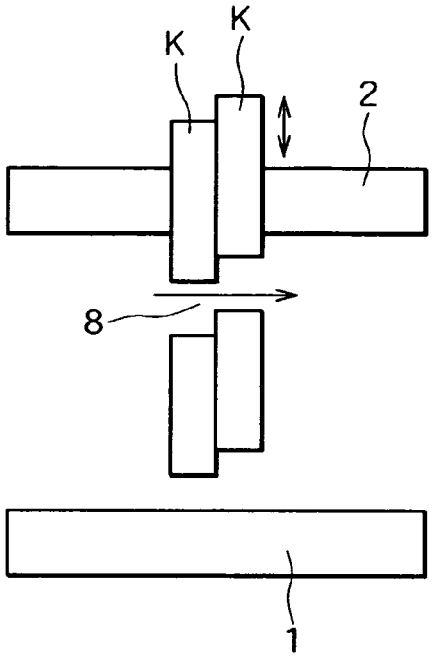
FIG. 8 (2)
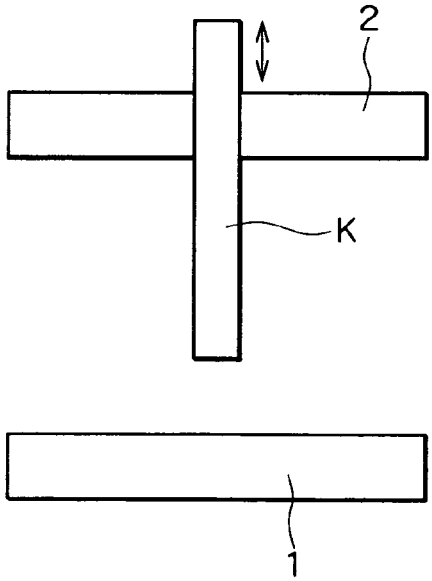

METHOD AND APPARATUS FOR PRODUCING REDUCED METAL

TECHNICAL FIELD

The present invention relates to improvements in methods for producing reduced iron by directly reducing iron oxide sources such as iron ore and iron oxide using carbonaceous reductants and/or reductive gas. The present invention particularly relates to a technique for properly controlling the flow of gas in a rotary hearth furnace.

BACKGROUND ART

In direct iron-making processes, iron oxide sources such as iron ore and iron oxide are directly reduced into reduced iron with carbonaceous reductants (hereinafter referred to as carbonaceous materials in some cases) or reducing gas. In a known direct iron-making process, a feedstock containing iron oxide such as iron ore and a carbonaceous material such as coal is fed onto a moving bed included in a rotary hearth furnace; the iron oxide is reduced into iron with the carbonaceous material by heating the feedstock with burners and radiation heat; the reduced iron is carburized, melted, and then allowed to coalesce; the resulting reduced iron is separated from molten slag; and the resulting reduced iron is solidified into granules by cooling.

In order to efficiently produce reduced iron with a high degree of reduction, the inventors have proposed a technique for separately controlling the flow of atmosphere gas and the temperature in such a rotary hearth furnace including a prior heating/reducing zone and a subsequent carburizing/melting/coalescing zone by providing at least one partition between these zones.

In order to achieve further improvements, the inventors have continued to perform investigation. In particular, the inventors have studied to solve a problem that the degree of reduction is cannot be sufficiently increased due to oxidizing gas.

In the known processes, furnaces have furnace gas outlets, placed in appropriate sections of the furnaces, for discharging combustion gas because an increase in the content of oxidizing gases such as carbon dioxide and water prevents the increase of the degree of reduction, the oxidizing gases being generated from burners during combustion for heating. Since the combustion gas is discharged, air is pulled into the furnaces through spaces around feedstock-feeding units and/or reduced iron-discharging units in some cases. The inventors have found that the air inhibits the reduction of iron oxide.

The present invention has been made to solve the problem. It is an object of the present invention to provide a method for properly controlling the flow of gas in a furnace and also provide an apparatus for properly controlling the gas flow. The method and the apparatus are useful in preventing reduction from being inhibited by oxidizing gas.

DISCLOSURE OF INVENTION

The present invention provides a method, capable of solving the above problem, for controlling the flow of gas, that is, a method for producing reduced iron. The method includes a feedstock-feeding step of feeding a feedstock containing a carbonaceous reductant and an iron oxide-containing material into a rotary hearth furnace, a heating/reducing step of heating the feedstock to reduce iron oxide contained in the feedstock into reduced iron, a melting step of melting the reduced iron, a cooling step of cooling the molten reduced iron, and a discharging step of discharging the cooled reduced iron, these steps being performed in that order in the direction that a hearth is moved. The furnace includes flow rate-controlling partitions, arranged therein, for controlling the flow of furnace gas and the furnace gas in the cooling step is allowed to flow in the direction of the movement of the hearth using the flow rate-controlling partitions.

The present invention provides another method for producing reduced iron. This method includes a feedstock-feeding step of feeding a feedstock containing a carbonaceous reductant and an iron oxide-containing material into a rotary hearth furnace, a heating/reducing step of heating the feedstock to reduce iron oxide contained in the feedstock into reduced iron, a melting step of melting the reduced iron, a cooling step of cooling the molten reduced iron, and a discharging step of discharging the cooled reduced iron, these steps being performed in that order in the direction that a hearth is moved. The furnace includes flow rate-controlling partitions, arranged therein, for controlling the flow of furnace gas and the pressure of the furnace gas in the melting step is maintained higher than that of the furnace gas in other steps using the flow rate-controlling partitions.

In the present invention, it is preferable that the heating/reducing step is partitioned into at least two zones with one of the flow rate-controlling partitions, one of the zones that is located upstream of the other one in the direction of the movement of the hearth has a furnace gas outlet, and the flow of the furnace gas is controlled by discharging the furnace gas from the furnace gas outlet.

Furthermore, the flow of the furnace gas is preferably controlled in such a manner that the heating/reducing step is partitioned into at least three zones by providing one of the flow rate-controlling partitions at a position that is located upstream of the furnace gas outlet in the direction of the movement of the hearth.

At least one of the partitions preferably has one or more perforations and/or is vertically movable.

In the present invention, the flow of the furnace gas is preferably controlled by varying the aperture of the one or more perforations.

The present invention provides an apparatus for producing reduced iron. The apparatus includes a rotary hearth furnace for performing a feedstock-feeding step of feeding a feedstock containing a carbonaceous reductant and an iron oxide-containing material into a rotary hearth furnace, a heating/reducing step of heating the feedstock to reduce iron oxide contained in the feedstock into reduced iron, a melting step of melting the reduced iron, a cooling step of cooling the molten reduced iron, and a discharging step of discharging the cooled reduced iron, these steps being performed in that order in the direction that a hearth is moved. The rotary hearth furnace includes a vertically movable flow rate-controlling partition for controlling the flow of furnace gas and/or a flow rate-controlling partition having one or more perforations for controlling the flow rate of the furnace gas, these partitions being arranged in the rotary hearth furnace.

In the present invention, it is preferable that the heating/reducing step is partitioned into at least two zones with one of the flow rate-controlling partitions and one of the zones that is located upstream of the other one in the direction of the movement of the hearth has a furnace gas outlet.

Furthermore, the heating/reducing step is preferably partitioned into at least three zones by providing one of the flow rate-controlling partitions at a position that is located upstream of the furnace gas outlet in the direction of the movement of the hearth.

The flow rate-controlling partition having the one or more perforations preferably has an adjuster for adjusting the aperture of the one or more perforations.

BRIEF DESCRIPTION OF THE DRAWINGS

FIG. 5(1) is a schematic view showing an example of a flow rate-controlling partition when viewed in the direction that a hearth is moved and FIG. 5(2) is a schematic sectional view showing the flow rate-controlling partition taken along the line A-A.

FIGS. 8(1) and 8(2) are schematic sectional views each showing an example of a vertically movable flow rate-controlling partition.

BEST MODE FOR CARRYING OUT THE INVENTION

Figure 1:
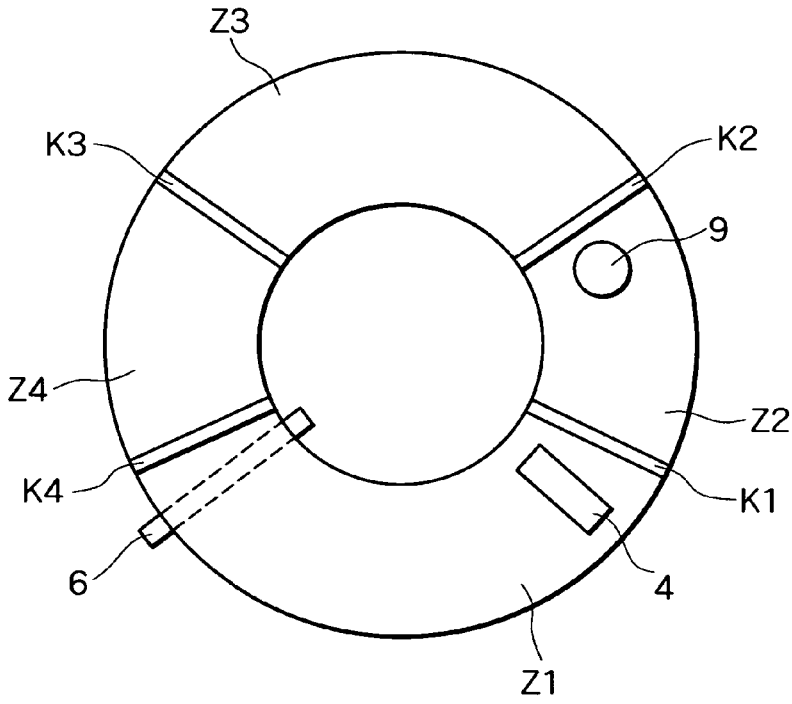
FIG. 1 is a schematic plan view showing a configuration of a rotary hearth furnace.

During the operation of a rotary hearth furnace, a feedstock is fed to the rotary hearth from a feeding unit so as to form a layer having an appropriate thickness while a rotary hearth is being rotated at a predetermined speed (a feedstock-feeding step). The feedstock placed on the rotary hearth is exposed to combustion heat and radiation heat generated from burners while the feedstock is being processed in a heating/reducing step, whereby iron oxide contained in the feedstock is reduced with a carbonaceous reductant contained in the feedstock and carbon monoxide generated from the combustion. In a melting step, the reduced iron produced by the reduction is further heated in a reducing atmosphere, whereby the resulting reduced iron is melted (preferably carburized and then melted) and then allowed to coalesce to form granules while the molten reduced iron is being separated from by-product slag. In a cooling step, the reduced iron is cooled with an arbitrary cooling unit and solidified. In a subsequent discharging step, the reduced iron is continuously discharged with a discharging unit. In this step, although the slag is discharged, the reduced iron and the slag are separated from each other with an arbitrary separation unit (for example, a screen or a magnetic separation system) after they pass through a hopper. The reduced iron obtained has an iron content of 95% or more and more preferably 98% or more but has an extremely low slag content.

The reduction of the iron oxide, the melt, and the coalescence can be usually finished in twenty minutes although this time slightly varies depending on the content of the iron oxide in the feedstock, the mixing ratio of iron oxide-containing substances contained in the feedstock to the carbonaceous reductant, and the composition of the feedstock.

In order to solve a problem that the degree of reduction of reduced iron cannot be sufficiently increased when the reduced iron is produced by the above method using the rotary hearth furnace, the inventors have investigated the flow of gas in the furnace. The investigation showed that when a furnace gas outlet is placed in the heating/reducing step or the melting step, air is pulled into the furnace from the feedstock-feeding step and the discharging step and inhibits the reduction of the iron oxide.

The air flowing toward the heating/reducing step is consumed in this step during burner combustion, the feedstock in this step is in reduction, and the atmosphere surrounding the feedstock is reductive; hence, the reduction of the iron oxide is rarely inhibited. However, the air flowing from the discharging step toward the cooling step is likely to inhibit the reduction of the iron oxide while the reduced iron is being moved in an end stage of the cooling step.

Since the insufficient reduction of iron oxide causes insufficient carburization, the melting point of iron is not decreased to a temperature suitable for efficient production; hence, high-purity reduced iron cannot be readily produced by an ordinary method.

After the carburization, melt, and coalescence of the reduced iron are finished, the reducing ability of atmosphere gas (furnace gas) is greatly decreased. In actual operation, since the molten, coalescing reduced iron is almost completely separated from by-product slag, the reduced iron is hardly affected by the atmosphere gas; hence, the problem is hardly caused by the air in the cooling step.

According to the present invention, in order to produce reduced iron by reducing and melting a carbonaceous reductant (hereinafter referred to as a carbonaceous material in some cases) such as coke or coal and a feedstock containing an iron oxide-containing substance (hereinafter referred to as iron ore or the like in some cases) such as iron ore, iron oxide, or a partially reduced product thereof, furnace gas flowing in a cooling step is allowed to flow in the direction of the movement of a hearth by providing flow rate-controlling partitions for controlling the flow of the furnace gas in a furnace and oxidizing gas is therefore prevented from flowing from a discharging step to the cooling step, whereby reduced iron with a high degree of reduction can be efficiently obtained with high reproducibility. In particular, the flow rate of the furnace gas flowing in the steps is controlled with the flow rate-controlling partitions that can control the flow of the furnace gas, whereby the direction that the furnace gas flows is varied. Positions at which the flow rate-controlling partitions are placed are not particularly limited and the flow rate-controlling partitions are preferably placed in such areas that the furnace gas flowing in the cooling step can be allowed to flow in the direction that the hearth is moved.

According to the present invention, the furnace gas is allowed to flow from a melting step to the cooling step in such a manner that the flow rate-controlling partitions for controlling the flow of the furnace gas are provided in the furnace and the pressure of the furnace gas in the melting step is maintained higher than that of the furnace gas in other steps, thereby solving the above problem that the degree of reduction of the reduced iron is not sufficiently high due to oxidizing gas flowing from the cooling step. The positions of the flow rate-controlling partitions are not particularly limited and the flow rate-controlling partitions may be placed at any positions such that the pressure of the furnace gas in the melting step can be maintained higher than that of the furnace gas in other steps. For example, it is preferable that the melting step is separated from the heating/reducing step with one of the flow rate-controlling partitions and the melting step is separated from the cooling step with another one of the flow rate-controlling partitions. If the melting step is isolated as described above, the pressure of the furnace gas in the melting step can be maintained higher than that of the furnace gas in other steps by an effect described below.

Embodiments of the present invention will now be described in detail with reference to the accompanying drawings; however, it should be construed that the present invention is not limited to the embodiments.

In the production of reduced iron with a rotary hearth furnace, when the temperature of an atmosphere in the furnace is excessively high, that is, when the atmosphere temperature exceeds the melting point of slag containing gangue components contained in raw materials, unreduced iron oxide, and other components during a period in which the iron oxide is being reduced, the low-melting point slag is melted and reacts with refractory materials used in the rotary hearth furnace to wear the refractory materials. This leads to a deterioration in the flatness of the hearth. Furthermore, if the iron oxide in reduction is heated to a temperature higher than that necessary for the reduction, the iron oxide, FeO, contained in the raw materials is melted before the iron oxide is reduced. The molten FeO reacts with carbon (C) in the carbonaceous material, that is, smelting reduction (a phenomenon in which a molten compound is reduced and which is different from solid reduction) rapidly proceeds. Although reduced iron can be produced by the smelting reduction, the smelting reduction causes the FeO-containing slag with high fluidity to seriously wear the refractory materials; hence, the furnace cannot be continuously operated in practical use.

Therefore, in order to efficiently perform a series of a heating/reducing step, a melting step, and a coalescing step, the temperature and atmosphere gas are preferably controlled properly for each step. If, for example, aggregated raw materials (hereinafter referred to as source aggregates) are used, it is preferable that the rotary hearth furnace is partitioned into zones arranged in the direction that the hearth is moved and the temperature of each step and the composition of the furnace gas in the step is separately controllable, in order to increase the degree of reduction (the percentage of removed oxygen) to 95% or more, preferably 97% or more, and more preferably 99% or more in such a manner that the source aggregates are maintained solid and slag components contained in the source aggregates are not partly melted. In particular, solid reduction is preferably performed in such a manner that the temperature of the heating/reducing step is maintained at 1200° C. to 1500° C., preferably 1200° C. to 1400° C.

When the time of a reducing sub-step included in the heating/reducing step is long, various problems including the following problem occur in the end or final stage of the reduction: a problem that the iron oxide is melted due to a difference in the degree of reduction of the iron oxide. A difference in degree of reduction between the source compacts can be decreased by enhancing the reduction of the iron oxide with a low degree of reduction in such a manner that the heating/reducing step is divided such that the final stage (a stage in which the degree of reduction is 80% or more is referred to as the final stage) of the heating/reducing step is separated from the heating/reducing step so as to act as an independent step (hereinafter referred to as a reduction-enhancing step in some cases), whereby the reduced iron with a high degree of reduction can be obtained in this step. The source aggregates are preferably subjected to the reduction-enhancing step at the point of time when the degree of reduction of the iron oxide reaches a certain value (preferably 80% or more). The iron oxide is preferably reduced in such a manner that the temperature of the reduction-enhancing step is maintained at 1200° C. to 1500° C. (a temperature at which melt does not occur).

In the case that the degree of reduction of the solid iron oxide is not sufficiently high, when the source compacts are melted in the melting step by heating, the low-melting point slag oozes from the source aggregates to wear the refractory materials. If the degree of reduction is increased to a high level (preferably 95% or more) and the source compacts are then melted in the melting step by heating, FeO remaining in the source compacts is reduced regardless of the grade and/or percentage of iron ore in the source compacts; hence, the amount of the oozing slag is small and the refractory materials are therefore hardly worn. Thus, stable continuous operation can be performed.

It is preferable that the remaining iron oxide is reduced and the reduced iron produced is carburized, melted, and then allowed to coalesce in such a manner that the temperature of the melting step is maintained at 1350° C. to 1500° C. This is because granules of the reduced iron can be efficiently produced with high reproducibility.

In order to control the temperature of each step within a preferable range as described above, it is preferable that the steps are separated from each other with partitions and the separated zones are separately controlled for temperature.

It is known that steps are separated from each other with partitions. The known partitions are used to control the temperature of these steps within a preferable range and do not have any function of controlling the flow of furnace gas nor any function of adjusting the pressure of each step; hence, the known partitions have the problem that the degree of reduction cannot be sufficiently increased as described above.

FIG. 1 shows a preferable rotary hearth furnace including a furnace body 2, four partitions K1, K2, K3, and K4, and a hearth 1. The furnace body 2 has four zones: a feedstock-feeding zone Z1, a heating/reducing zone Z2 (corresponding to a heating/reducing step), a melting zone Z3 (corresponding to a melting step), and a cooling zone Z4 (corresponding to a cooling step) which are placed therein, which are separated from each other with the partitions K1, K2, K3, and K4, and which are arranged in the direction that the hearth 1 is moved. The feedstock-feeding zone Z1 includes a feeding unit 4, such as a hopper, used in a feedstock-feeding step and a discharging unit 6 (located upstream of the discharging unit 6 because of the rotary structure), such as a scraper, used in a discharging step and the hearth 1 is disposed between the feeding unit 4 and the discharging unit 6.

Figure 2:
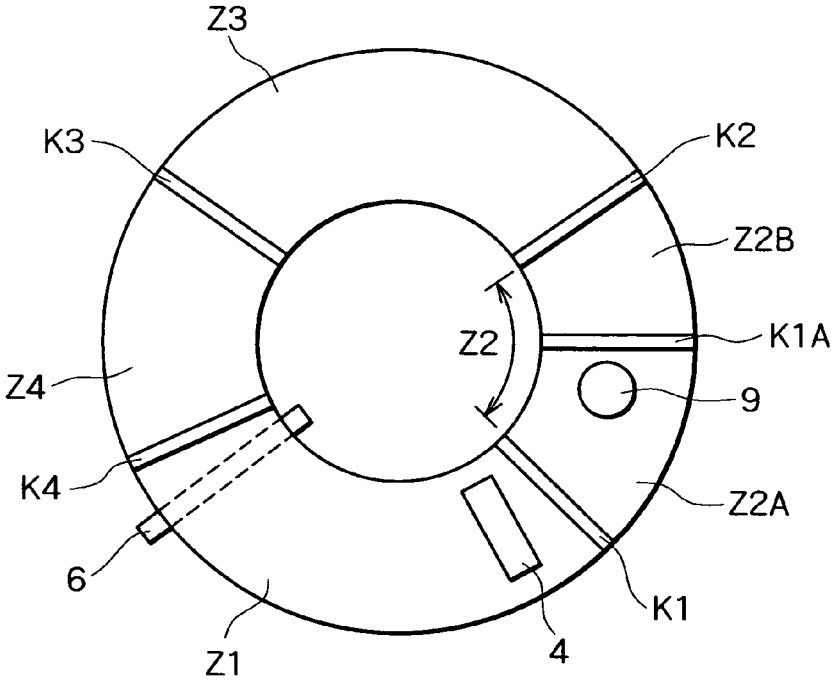
FIG. 2 is a schematic plan view showing a configuration of another rotary hearth furnace.

The present invention is not limited to such separated zones. The number of the zones may be arbitrarily varied depending on the size, target production capacity, or operation of the furnace. As shown in FIG. 2, the heating/reducing step may be partitioned into a heating/reducing sub-zone Z2A (a heating/reducing sub-step) and a reduction-enhancing sub-zone Z2B (a reduction-enhancing zone) with a partition K1A such that the heating/reducing sub-zone Z2A is located upstream of the reduction-enhancing sub-zone Z2B.

A feedstock fed from the feeding unit 4 is defined as a kind of powder; a powder mixture containing two or more kinds of powder; or aggregates, prepared by processing the powders, having a shape such as a pellet or briquette shape. The feedstock may contain raw materials, auxiliary raw materials, and an additive. Examples of the feedstock used to produce reduced iron include powder mixtures (which may further contain another component) prepared by mixing iron oxide-containing powders and carbonaceous materials; various source powders such as iron oxide-containing powders and carbonaceous material-containing powders; aggregates prepared by processing these powders, having a shape such as a pellet or briquette shape; various auxiliary raw materials such as carbonaceous material-containing powders placed on hearths, refractory material powders, slag powders, basicity regulators (lime and the like), hearth-repairing materials (for example, the same materials as those for manufacturing hearths), and melting-point regulators (alumina, magnesia, and the like); and additives. The feedstock is not limited to these examples and may contain any powder or aggregates that can be fed into the furnace. The auxiliary raw materials or the additive may be fed into the furnace with another feeding unit placed in an arbitrary section.

The auxiliary raw materials preferably include a carbonaceous material because the carbonaceous material functions as an atmosphere regulator to promote carburization, melt, and coalescence. The carbonaceous material may be placed over the hearth before the source aggregates are fed onto the hearth. Alternatively, the carbonaceous material may be dusted onto the hearth just before the source aggregates are carburized and then melted. The amount of the carbonaceous material used may be adjusted depending on the reducing ability of atmosphere gas used during operation.

In the present invention, the rotary hearth furnace further includes a plurality of combustion burners 3 each placed in respective sections of a wall of the furnace body 2. The source aggregates are heated and reduced by applying combustion heat and radiation heat to the source aggregates from the combustion burners 3 (see FIG. 4). Combustion gas generated from the burners is discharged through a furnace gas outlet 9.

A section in which the furnace gas outlet 9 is placed is not particularly limited. However, if the furnace gas outlet 9 is placed in the melting zone Z3, the degree of reduction of reduced iron moved in the melting zone Z3 cannot be sufficiently increased due to the furnace gas flowing from the heating/reducing zone Z2 because the combustion gas is oxidative. Therefore, the furnace gas outlet 9 is preferably placed in the heating/reducing zone Z2.

According to the present invention, the above problem is solved in such a manner that the furnace gas is controlled with the flow rate-controlling partitions for controlling the flow of the furnace gas such that the furnace gas is allowed to flow toward the cooling step in the direction that the rotary hearth furnace is moved. Furthermore, the above problem is solved in such a manner that the furnace gas is controlled with the flow rate-controlling partitions such that the pressure of the furnace gas in the melting step is maintained higher than that of the furnace gas in other steps.

According to the present invention, air is prevented from entering the cooling zone Z4 and the melting zone Z2 in such a manner that the furnace gas is allowed to flow in the direction that the hearth is moved, preferably in the direction from the cooling zone Z4 to the feedstock-feeding zone Z1, using the flow rate-controlling partitions. Furthermore, the furnace gas is allowed to flow in the direction from the melting zone to the cooling zone Z4 in such a manner that the pressure of the furnace gas in the melting zone Z3 is increased with the flow rate-controlling partitions, whereby the above problem caused by the air entering the cooling zone Z4 is solved.

According to the present invention, in order to allow the furnace gas in the cooling step to flow in the direction that the hearth is moved, the flow rate-controlling partitions for controlling the flow of the furnace gas are placed in respective sections of the furnace.

If flow rate-controlling partitions, having perforations, for controlling the flow of the furnace gas are used, these rate-controlling partitions may be placed in respective sections of the furnace. In order to maintain the pressure of the furnace gas in the melting step higher than that of the furnace gas in other steps, the rate-controlling partitions may be placed in respective sections of the furnace.

Since operating conditions vary depending on the raw materials, the feed rate thereof, the content of the carbonaceous material, and the like, proper control cannot be performed if known fixed partitions are used instead of the flow rate-controlling partitions. Therefore, the flow rate-controlling partitions each having one or more perforations and/or vertically movable flow rate-controlling partitions (hereinafter simply referred to as flow rate-controlling partitions in some cases) are preferably used such that the flow rate of the furnace gas can be controlled depending on operating conditions. The shape and other features of the flow rate-controlling partitions are not particularly limited and the flow rate-controlling partitions may have any features other than those described above such that the above advantage can be achieved.

The flow rate-controlling partitions each having one or more perforations are defined as walls having holes communicatively connecting the zones to each other. The shape, number, size, and positions of the perforations are not particularly limited.

In order to prevent the reducing atmosphere surrounding the source aggregates from being disturbed as described below, perforations 8 shown in FIG. 5(1) are preferably arranged in an upper region of a flow rate-controlling partition K (when the partition is divided into two upper and lower equal parts, the perforations are arranged in the upper part) and more preferably arranged in a region close to the ceiling of the furnace (when the partition is divided into three equal parts, the perforations are arranged in the uppermost part).

When there is a difference in temperature between the zones, it is preferable that radiation heat is not transmitted to other zones through the perforations. However, if the perforations have a large aperture area such that the sum of the aperture areas thereof is equal to a desired value, radiation heat cannot be readily blocked. Hence, it is preferable that the number of the perforations is large and the perforations have a small aperture area.

In order to control the pressure (atmospheric pressure) in furnace gas-flowing spaces (that is, spaces in the zones) partitioned with the flow rate-controlling partitions having the perforations, aperture adjusters for adjusting the aperture of the perforations are preferably used to adjust the aperture area of the perforations. The aperture adjusters are not particularly limited and examples thereof include movable covers placed on the openings of the perforations. Alternatively, as shown in FIG. 8(1), the aperture thereof may be adjusted in such a manner that a plurality of pairs of the flow rate-controlling partitions having the perforations are each vertically moved (or laterally moved) independently.

Figure 7:
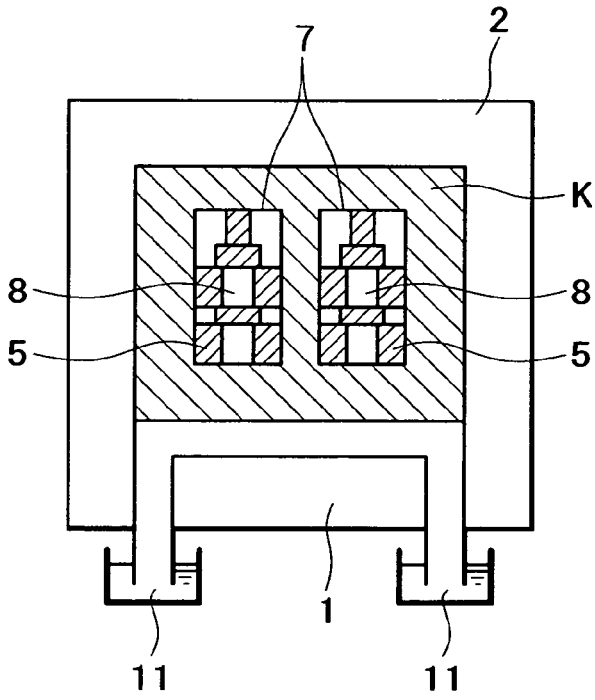
FIG. 7 is a schematic sectional view showing an example of a flow rate-controlling partition when viewed in the direction that a hearth is moved.

Alternatively, as shown in FIG. 7, the aperture area and the number of openings may be adjusted in such a manner that open sections 7 are arranged in the flow rate-controlling partitions and heat-resistant members 5 such as bricks are stacked in the open sections so as to form a checker pattern. The open sections 7 and the heat-resistant members 5 are preferably used as described above because the aperture area, number, and positions of the openings can be readily adjusted by varying the arrangement or number of the heat-resistant members.

In order to prevent the temperature of regions around the open sections 7 or the perforations 8 from increasing, the flow rate-controlling partitions K preferably have cooling units (not shown) when the open sections 7 or the perforations 8 are arranged in the flow rate-controlling partitions K as described above.

Figure 6:
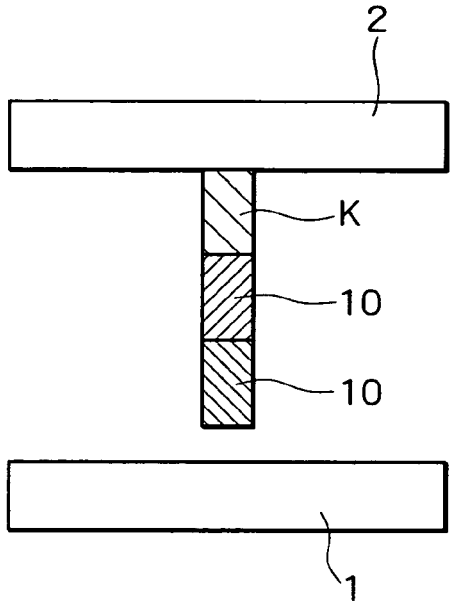
FIG. 6 is a schematic sectional view showing a divisible flow rate-controlling partition.

The vertically movable flow rate-controlling partitions are defined as walls that can adjust the distance between the lower end of each wall and the surface (a portion of the hearth that is located closest to the lower end thereof) of the hearth (see FIG. 8(2)). A method for vertically moving these walls is not particularly limited and these flow rate-controlling partitions may be vertically moved using a known hoisting and lowering machine. Alternatively, a divisible flow rate-controlling partition shown in FIG. 6 may be used. The distance between this partition and the hearth may be adjusted in such a manner that partition parts 10 may be attached to or removed from the lower end of this partition (the partition parts may be attached thereto by a known technique such as engagement or screw fixing). This flow rate-controlling partition is preferably movable vertically because the flow of the furnace gas can be readily controlled depending on the pressure in the furnace in such a manner that the difference in pressure between the zones is adjusted by varying the distance therebetween. This flow rate-controlling partition may extend through the ceiling of the furnace so as to be vertically movable in the same manner as that of the flow rate-controlling partitions (K1A and K2) shown in FIG. 4. This vertically movable flow rate-controlling partition may have a perforation.

By adjusting the space (a gas-flowing channel) between the lower end of the vertically movable flow rate-controlling partition and the hearth in such a manner that this partition is moved and/or by adjusting the sum of the aperture areas of the perforations arranged in the flow rate-controlling partitions in such a manner that the number and/or aperture area of the perforations is varied, the difference in pressure between the zone located directly upstream of each partition in the direction that the hearth is moved and the zone located directly downstream thereof can be adjusted and the pressure in other zones is therefore varied; hence, the flow of the furnace gas can be controlled. The pressure in a specific zone can be maintained higher than that in other zones adjacent to the specific zone using the flow rate-controlling partitions.

In the present invention, the positions of the flow rate-controlling partitions are not particularly limited and the flow rate-controlling partitions may be placed at any positions such that the furnace gas in the cooling zone Z4 can be allowed to flow in the direction that the hearth is moved in such a manner that the difference in pressure between the zones in which the furnace gas flows is controlled with the flow rate-controlling partitions. Furthermore, the flow rate-controlling partitions may be placed at any positions such that the pressure of the furnace gas in the melting zone Z3 can be maintained higher than that in other zones.

In order to allow the furnace gas to flow in the direction from the cooling zone Z4 to the feedstock-feeding zone Z1, the pressure in the zones in which the furnace gas flows is preferably controlled in such a manner that gas-flowing channels in the flow rate-controlling partitions are enlarged by providing the flow rate-controlling partitions on the partition K4 and/or K1 in addition to the partition K2 and/or K3. Since the furnace gas flowing in the direction from the cooling zone Z4 to the feedstock-feeding zone Z1 is cooled in the cooling zone Z4, an increase in the flow rate of the cool furnace gas flowing in the heating/reducing zone Z2 leads to an increase in heat loss. This is not preferable.

If the furnace gas flows such that the furnace gas flowing out of the feedstock-feeding zone Z1 does not enter the cooling zone Z4, the problem of the degree of reduction does not occur. Therefore, the difference in pressure between the cooling zone Z4 and the feedstock-feeding zone Z1 may be very small (the pressure in the cooling zone Z4 is higher than that in the feedstock-feeding zone Z1).

In the present invention, the flow rate-controlling partitions are preferably arranged and operated such that the flow rate of the furnace gas flowing from the cooling zone Z4 into the heating/reducing zone Z2 through the feedstock-feeding zone Z1 is minimized. The flow rate-controlling partitions are preferably provided on the partition K2 and more preferably provided on the partitions K2 and K3.

If the difference in pressure between the zones is controlled with the flow rate-controlling partitions used for the partition K2, the furnace gas can be allowed to flow in the direction from the melting zone Z3 to the heating/reducing zone Z2 and also allowed to flow in the direction from the melting zone Z3 to the cooling zone Z4. Since a considerable amount of gas such as CO is generated in the melting zone Z3 although the amount of the gas generated in the melting zone Z3 is less than that of gas generated in the heating/reducing zone Z2, the pressure in the melting zone Z3 is higher than that in the cooling zone Z4 in which gas is hardly generated. Therefore, if a channel through which the furnace gas flows is narrowed by the flow rate-controlling partition such that the furnace gas flows toward the cooling zone Z4, the flow of the furnace gas can be properly controlled as described above.

When the partition K2 is movable, the partition K2 may be moved downward. When the partition K2 has perforations, the sum of the aperture areas of the perforations may be reduced. When the partition K2 has these features (the partition K2 is movable and has such perforations), the partition K2 may be moved downward and the sum of the aperture areas of the perforations may be reduced.

When the partitions K2 and K3 are the flow rate-controlling partitions, the flow of the furnace gas can be properly controlled. The furnace gas can be readily allowed to flow in the direction from the melting zone Z3 to the cooling zone Z4 in such a manner that, for example, the partition K2 is moved downward and the partition K3 is moved upward.

When only the partition K3 is the flow rate-controlling partition, the partition K3 is preferably moved upward such that the furnace gas flows in the direction from the melting zone Z3 to the cooling zone Z4.

In order to separately control the atmosphere temperature of the zones and/or the composition of atmosphere gas in the zones for each zone, the zones are preferably independent from each other. In particular, the space between the hearth and the lower end of each flow rate-controlling partition is preferably small.

When the zones are independent from each other, the flow rate of the furnace gas flowing in the zones through the space therebetween is large and the furnace gas therefore flows irregularly around the source aggregates; hence, the atmosphere surrounding the source aggregates cannot be maintained reductive and the source aggregates cannot be sufficiently reduced due to oxidizing gas in some cases. Therefore, if the reducing atmosphere surrounding the source aggregates is disturbed by lowering the movable flow rate-controlling partitions, the flow rate of the furnace gas flowing on the hearth is preferably controlled not to be extremely high in such a manner that the flow rate-controlling partitions having the perforations or movable flow rate-controlling partitions having perforations are used instead of the movable flow rate-controlling partitions. In particular, the flow rate-controlling partitions having the perforations are preferably used because the furnace gas can flow between the zones through the perforations and the flow rate of the furnace gas flowing through the space on the hearth can therefore be prevented from increasing.

FIG. 2 shows a furnace according to another embodiment of the present invention.

In the furnace shown in this figure, a heating/reducing zone is partitioned into at least two sub-zones with a flow rate-controlling partition. A sub-zone Z2A of the partitioned heating/reducing zone is located upstream of the other one in the direction that a hearth is moved and has a furnace gas outlet.

The position of the flow rate-controlling partition for partitioning the heating/reducing zone is not particularly limited. A large amount of CO gas is generated in an initial stage of the reduction performed in the heating/reducing zone Z2 as described above; however, the amount of CO gas generated is small after the reduction proceeds up to a certain level. Therefore, the heating/reducing zone is preferably partitioned such that the flow rate-controlling partition is located upstream of a section in which a large amount of CO gas is generated in the direction that the hearth is moved. The flow rate-controlling partition may be placed at such a position that the degree of reduction of iron oxide can be increased to a large value (preferably 80% or more). In the partitioned heating/reducing zone (the sub-zone Z2A for performing a heating/reducing step and a sub-zone Z2B for performing a reduction-enhancing step), combustion gas is preferably discharged from the furnace gas outlet placed in the sub-zone Z2A. Although the combustion gas flows into the sub-zone Z2A from other zones because of the discharge of furnace gas, the degree of reduction of the aggregates (reduced iron) can be increased by a self-shielding effect because a large amount of CO gas is generated in the sub-zone Z2A as described above.

Furthermore, when the furnace gas outlet is placed in a rear area (located downstream in the direction that the hearth is moved) of the sub-zone Z2A, the degree of reduction can be increased in the sub-zone Z2A and the furnace gas can be readily allowed to flow in the direction from the sub-zone Z2B to the sub-zone Z2A. When the heating/reducing zone Z2 is partitioned (the sub-zones Z2A and Z2B), the furnace gas can be allowed to flow in the direction from a cooling zone to the feedstock-feeding zone in such a manner that the pressure in the space in which the furnace gas flows is controlled by providing a flow rate-controlling partition on a partition K1A.

Furthermore, partitions K2 and K3 are preferably flow rate-controlling partitions because pressure control is easy and the furnace gas can be readily allowed to flow from the melting zone Z3.

When the heating/reducing zone Z2 is partitioned into the two sub-zones as shown in this figure, the partition K1A is preferably a flow rate-controlling partition and the partitions K1A and K2 are more preferably flow rate-controlling partitions. The flow rate-controlling partitions and a known partition can be used in combination if the furnace gas can be allowed to flow in the direction from the cooling zone to the feedstock-feeding zone.

Figure 3:
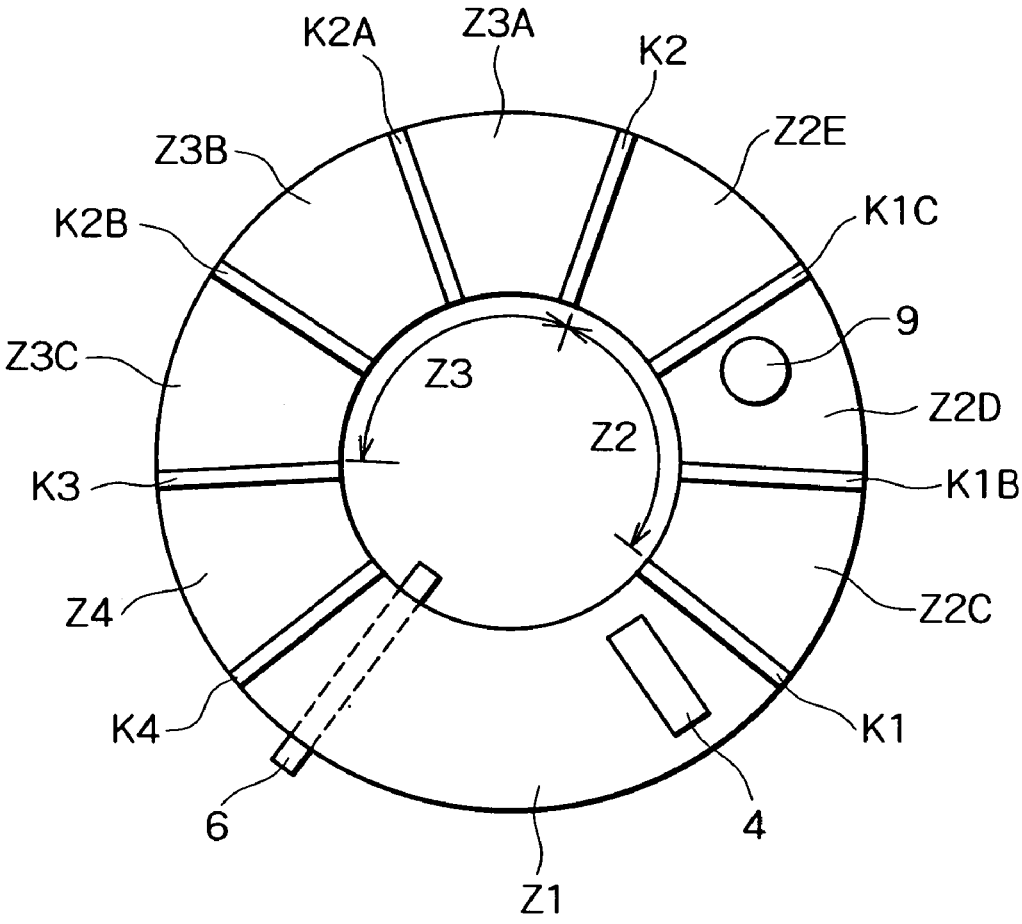
FIG. 3 is a schematic plan view showing a configuration of another rotary hearth furnace.

FIG. 3 shows a furnace according to another embodiment of the present invention.

In the furnace shown in this figure, a heating/reducing zone Z2 is partitioned into at least three sub-zones with flow rate-controlling partitions. A sub-zone Z2D located in the middle of the partitioned heating/reducing zone has a furnace gas outlet.

The positions of the flow rate-controlling partitions are not particularly limited and the flow rate-controlling partitions may be arranged at any positions such that the heating/reducing zone is partitioned. The heating/reducing zone may be partitioned into, for example, three equal parts. It is preferable that the furnace gas outlet is placed at a position at which the amount of CO gas generated is reduced, a flow rate-controlling partition K1B is placed at a position which is located close to and upstream of the furnace gas outlet, and a flow rate-controlling partition K1C is placed at a position which is located close to and downstream of the furnace gas outlet. According to such a configuration, the difference in pressure between a sub-zone Z2E and the sub-zone Z2D can be controlled with the flow rate-controlling partition K1C and the difference in pressure between a sub-zone Z2C and the sub-zone Z2D can be controlled with the flow rate-controlling partition K1B. If a flow rate-controlling partition is used for the partition K1C and/or K1B, the pressure in spaces in which furnace gas flows can be readily controlled, whereby the furnace gas can be allowed to flow in the direction from a cooling zone to a feedstock-feeding zone.

In the present invention, the pressure is preferably controlled such that the furnace gas is allowed to flow from a melting zone Z3. The flow rate-controlling partition is preferably provided on the partition K1C or K1B as described above. In particular, flow rate-controlling partitions are preferably provided on the partitions K1C and K1B because the pressure control can be properly performed.

Flow rate-controlling partitions are preferably provided on partitions K2A and K3 because the pressure control is easy and the furnace gas can be allowed to flow from the melting zone Z3.

When the heating/reducing zone Z2 is partitioned into the three sub-zones as shown in this figure, the partition K1C is preferably a flow rate-controlling partition and the partitions K1C and K1B are more preferably flow rate-controlling partitions. The flow rate-controlling partitions and a known partition can be used in combination if the furnace gas can be allowed to flow in the direction from the cooling zone to the feedstock-feeding zone.

Alternatively, the melting zone Z3 may be partitioned into a plurality of sub-zones in such a manner that one or more flow rate-controlling partitions are arranged therein. The one or more flow rate-controlling partitions are not particularly limited if the furnace gas is allowed to flow in the direction from the cooling zone Z4 to the feedstock-feeding zone Z1 and preferably allowed to flow in the direction from the melting zone Z3 to the cooling zone Z4 and in the direction from the melting zone Z3 to the heating/reducing zone Z2 in such a manner that the pressure in the sub-zones of the partitioned melting zone is controlled. In order to partition the melting zone Z3, the one or more flow rate-controlling partitions are preferably used and may be used in combination with a known partition.

The difference in pressure between the sub-zones of the melting zone Z3 is preferably controlled in such a manner that the melting zone Z3 is partitioned into the two sub-zones and preferably the three sub-zones (Z3A, Z3B, and Z3C) as shown in FIG. 3. This is because the furnace gas can be allowed to flow in the direction from the melting zone Z3 to the cooling zone Z4 and also allowed to flow in the direction from the melting zone Z3 to the heating/reducing zone Z2.

Figure 4:
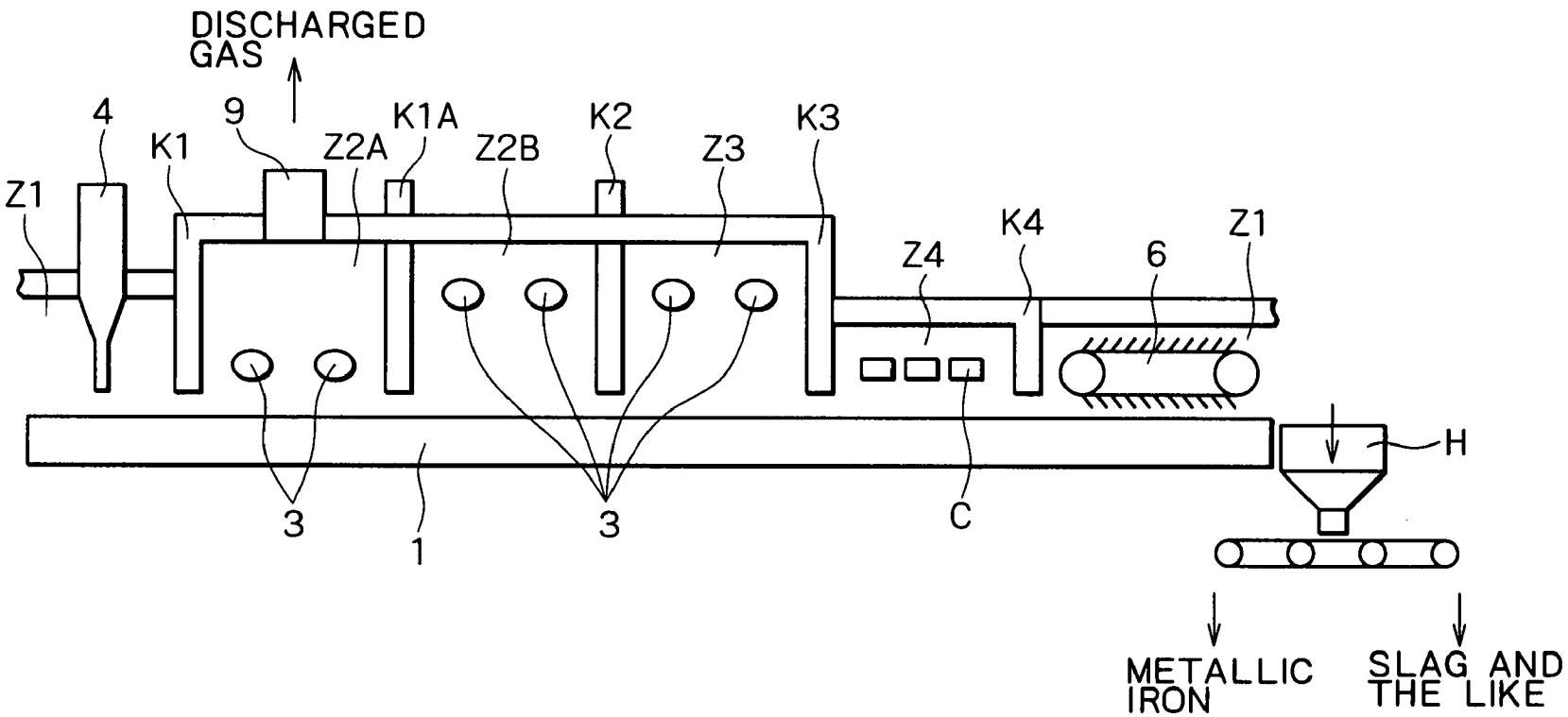
FIG. 4 is a schematic developed view showing the rotary hearth furnace shown in FIG. 2 in cross section.

FIG. 4 is a schematic developed view showing the rotary hearth furnace shown in FIG. 2. The flow rate-controlling partitions are provided on the partitions K1A and K3. In this figure, the combustion burners 3 placed in the sub-zone Z2A are arranged close to the hearth and the combustion burners 3 placed in the sub-zone Z2B or the heating/reducing zone Z2 are arranged in upper regions of the furnace. It is preferable that the combustion burners 3 are arranged close to the hearth (the sub-zone Z2A) because generated gas is burned and heating is therefore promoted. It is preferable that the combustion burners are arranged in the furnace upper regions (the sub-zone Z2B and the melting zone Z3) because the flow of gas flowing around the raw materials can be prevented from being disturbed due to gas generated from the combustion burners.

Combustion burners used in the present invention are preferably of a low velocity type and more preferably of a nozzle mix type (fuel gas and air are mixed in a nozzle) because a burner flame is stable.

In the present invention, the following example is described: an example in which a series of steps of producing reduced iron from iron oxide are performed in a rotary hearth furnace. A method and apparatus of the present invention are useful in producing reduced iron if the rotary hearth furnace is used in a step of reducing an oxide such as iron oxide. After iron oxide is only reduced in the rotary hearth furnace, the reduced product may be fed to another step (for example, a melting furnace).

INDUSTRIAL APPLICABILITY

According to the present invention, the degree of reduction of iron oxide can be increased and the carburization, melt, and coalescence can be readily performed; hence reduced iron can be efficiently produced.

The invention claimed is:

1. A method for producing reduced iron, comprising:

a feedstock-feeding step of feeding a feedstock containing a carbonaceous reductant and an iron oxide-containing material into a rotary hearth furnace having flow rate-controlling partitions arranged therein for controlling the flow of furnace gas, a heating/reducing step of heating the feedstock to reduce iron oxide contained in the feedstock into iron, a melting step of melting the reduced iron, a cooling step of cooling the molten reduced iron, and a discharging step of discharging the cooled reduced iron, these steps being performed in that order in the direction that a hearth is moved, wherein the furnace gas in the melting step flows in the direction of the movement of the hearth from the melting step to the cooling step using the flow rate-controlling partitions, and wherein the furnace gas in the cooling step flows in the direction of the movement of the hearth using the flow rate-controlling partitions, and oxidizing gas is prevented from flowing from the discharging step to the cooling step using the flow rate-controlling partitions.

2. The method according to claim 1, wherein the heating/reducing step is partitioned into at least two zones with one of the flow rate-controlling partitions, one of the zones that is located upstream of the other one in the direction of the movement of the hearth has a furnace gas outlet, and the flow of the furnace gas is controlled by discharging the furnace gas from the furnace gas outlet.

3. The method according to claim 2, wherein the flow of the furnace gas is controlled in such a manner that the heating/reducing step is partitioned into at least three zones by providing one of the flow rate-controlling partitions at a position that is located upstream of the furnace gas outlet in the direction of the movement of the hearth.

4. The method according to claim 1, wherein at least one of the flow rate-controlling partitions has one or more perforations.

5. The method according to claim 4, including a step of controlling the flow of the furnace gas in the direction of the movement of the hearth by varying a size of the aperture of the one or more perforations.

6. The method according to claim 1, including a step of controlling the flow of the furnace gas in the direction of the movement of the hearth by moving at least one of the partitions vertically.

7. The method according to claim 6, wherein at least one of the flow rate-controlling partitions has one or more perforations and the step of controlling the flow of the furnace gas in the direction of the movement of the hearth also includes varying the aperture of the one or more perforations.

8. A method for producing reduced iron, comprising:

a feedstock-feeding step of feeding a feedstock containing a carbonaceous reductant and an iron oxide-containing material into a rotary hearth furnace having flow rate-controlling partitions arranged therein for controlling the flow of furnace gas, a heating/reducing step of heating the feedstock to reduce iron oxide contained in the feedstock into iron, a melting step of melting the reduced iron, a cooling step of cooling the molten reduced iron, and a discharging step of discharging the cooled reduced iron, these steps being performed in that order in the direction that a hearth is moved, wherein the furnace gas in the melting step flows in the direction of the movement of the hearth from the melting step to the cooling step using the flow rate-controlling partitions, whereby the pressure of the furnace gas in the melting step is maintained higher than that of the furnace gas in other steps.

9. The method according to claim 8, wherein the pressure of the furnace gas in the cooling step is maintained higher than that of the gas in the feeding step using the flow rate-controlling partitions.

10. A method for producing reduced iron, comprising:

a feedstock-feeding step of feeding a feedstock containing a carbonaceous reductant and an iron oxide-containing material into a rotary hearth furnace having flow rate-controlling partitions arranged therein for controlling flow of furnace gas therepast, a heating/reducing step of heating the feedstock to reduce iron oxide contained in the feedstock into iron, a melting step of melting the reduced iron, a cooling step of cooling the molten reduced iron, and a discharging step of discharging the cooled reduced iron, these steps being performed in that order in the direction that a hearth is moved, wherein the furnace gas in the melting step flows in the direction of the movement of the hearth from the melting step to the cooling step using the flow rate-controlling partitions, wherein the pressure of the furnace gas in the cooling step is maintained higher than that of the gas in the feeding step, and wherein, due to the higher pressure of the furnace gas in the cooling step, the furnace gas in the cooling step flows in the direction of the movement of the hearth by using the flow rate-controlling partitions, but oxidizing gas is prevented by the flow rate-controlling partitions from flowing from the discharging step to the cooling step.

* * * * *